US009599379B2

(12) United States Patent
Ha et al.

(10) Patent No.: US 9,599,379 B2
(45) Date of Patent: Mar. 21, 2017

(54) INTEGRAL AIR CONDITIONING SYSTEM FOR HEATING AND COOLING

(71) Applicant: LG Electronics Inc., Seoul (KR)

(72) Inventors: Doyong Ha, Seoul (KR); Yoonho Yoo, Seoul (KR); Taehee Kwak, Seoul (KR); Jaeheuk Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 476 days.

(21) Appl. No.: 13/911,591

(22) Filed: Jun. 6, 2013

(65) Prior Publication Data

US 2014/0083122 A1 Mar. 27, 2014

(30) Foreign Application Priority Data

Sep. 24, 2012 (KR) ..... 10-2012-0105917

(51) Int. Cl.
*F25B 41/00* (2006.01)
*F25B 29/00* (2006.01)
(Continued)

(52) U.S. Cl.
CPC ..... *F25B 29/003* (2013.01); *F24F 1/16* (2013.01); *F24F 13/30* (2013.01); *F25B 6/04* (2013.01); *F25B 7/00* (2013.01); *F25B 13/00* (2013.01); *F25B 40/02* (2013.01); *F25B 40/06* (2013.01); *F25B 41/04* (2013.01); *F25B 49/02* (2013.01); *F28D 1/0443* (2013.01); *F28D 1/0477* (2013.01); *F28F 9/0275* (2013.01);
(Continued)

(58) Field of Classification Search
CPC ..... F25B 29/003; F25B 49/02; F25B 7/00; F25B 6/04; F25B 40/06; F25B 40/02; F25B 41/04; F25B 2700/1931; F25B 2313/0294; F28D 1/0443; F28D 1/0477; F24F 1/16; F24F 13/30; F28F 9/0275; F28F 27/02
See application file for complete search history.

(56) References Cited

U.S. PATENT DOCUMENTS

2006/0288716 A1* 12/2006 Knight ..... F25B 49/027 62/196.4
2010/0170270 A1* 7/2010 Jang ..... F25B 13/00 62/81
2013/0186284 A1* 7/2013 Van Poucke ..... A23L 1/1643 99/323.4

FOREIGN PATENT DOCUMENTS

CN 1156808 A 8/1997
EP 2 455 689 A2 5/2012
(Continued)

OTHER PUBLICATIONS

Hiroaki, Air Conditioner, Nov. 5, 1999, JPH11304309A, Whole Document.*
Kazuhiko et al., Heat Pump System Air Conditioner, Jan. 8, 2000, JP2000018734A, Whole Document.*

*Primary Examiner* — Larry Furdge
(74) *Attorney, Agent, or Firm* — Dentons US LLP

(57) ABSTRACT

An air conditioner includes a first compressor and a first indoor heat exchanger, and the air conditioner forming a first refrigeration cycle. A cooler includes a second compressor and a second indoor heat exchanger, and the cooler forming a second refrigeration cycle The cooler includes a sensing part to detect a pressure and/or temperature of a refrigerant circulating in the second refrigeration cycle; and a branch part includes a plurality of branches for dividing the refrigerant to be introduced into the second heat exchange part.

5 Claims, 6 Drawing Sheets

(51) Int. Cl.

| | |
|---|---|
| ***F25B 41/04*** | (2006.01) |
| ***F24F 13/30*** | (2006.01) |
| ***F25B 6/04*** | (2006.01) |
| ***F25B 7/00*** | (2006.01) |
| ***F25B 13/00*** | (2006.01) |
| ***F25B 40/02*** | (2006.01) |
| ***F25B 40/06*** | (2006.01) |
| ***F25B 49/02*** | (2006.01) |
| ***F28F 9/02*** | (2006.01) |
| ***F28F 27/02*** | (2006.01) |
| ***F24F 1/16*** | (2011.01) |
| ***F28D 1/04*** | (2006.01) |
| ***F28D 1/047*** | (2006.01) |
| *F28D 1/02* | (2006.01) |

(52) U.S. Cl.

CPC ..... *F28F 27/02* (2013.01); *F25B 2313/0294* (2013.01); *F25B 2313/02741* (2013.01); *F25B 2600/111* (2013.01); *F25B 2700/1931* (2013.01); *F25B 2700/21152* (2013.01); *F28D 2001/0273* (2013.01)

(56) References Cited

FOREIGN PATENT DOCUMENTS

| | | | | |
|---|---|---|---|---|
| EP | 2455689 | A2 | | 5/2012 |
| EP | 2 479 519 | A2 | | 7/2012 |
| EP | 2479519 | A2 | | 7/2012 |
| JP | H11304309 | A | * | 11/1999 |
| JP | 2000018734 | A | * | 1/2000 |
| JP | 2002-277087 | A | | 9/2002 |
| JP | 2002277087 | A | | 9/2002 |

* cited by examiner

FIG.5

| Valve adjustment stage | Valve mapping | | |
|---|---|---|---|
| | First valve | Second valve | Third valve |
| 1 stage | On | On | On |
| 2 stage | On | On | Off |
| 3 stage | On | Off | On |
| 4 stage | On | Off | Off |
| 5 stage | Off | On | On |
| 6 stage | Off | On | Off |
| 7 stage | Off | Off | On |

INTEGRAL AIR CONDITIONING SYSTEM FOR HEATING AND COOLING

This application claims priority to Korean Patent Application No. 10-2012-0105917 filed on Sep. 24, 2012, which is hereby incorporated by reference in its entirety.

The present disclosure relates to an integral air conditioning system for heating and cooling, and more particularly, to an integral air conditioning system for heating and cooling in which a first heat exchange part serving as an outdoor heat exchanger of an air conditioner and a second heat exchange part serving as an outdoor heat exchanger of a cooler are provided as one unit, wherein, when the air conditioner is operated in a heating mode, a rotation rate of a blower fan is matched with a required rotation rate of the first heat exchange part, and active area and/or position of the second heat exchange part are controlled by using a plurality of valves to improve cooling performance of the cooler.

In general, a refrigeration system is an apparatus for cooling an indoor space or storing foods at a low temperature environment by performing a refrigeration cycle including compression-condensation-expansion-evaporation.

The refrigeration system includes a compressor for compressing a refrigerant, an indoor heat exchanger in which the refrigerant and indoor air are heat-exchanged with each other, an expansion part for expanding the refrigerant, and an outdoor heat exchanger in which the refrigerant and outdoor air are heat-exchanged with each other. Also, the refrigeration system may further include a four-way valve for switching a flow direction of the refrigerant to perform the refrigeration cycle, a fan for respectively forcibly blowing the indoor air or the outdoor air into the indoor heat exchanger or the outdoor heat exchanger, and a motor for rotating the fan.

Also, when a cooling mode is performed, the indoor heat exchanger serves as an evaporation unit, and the outdoor heat exchanger serves as a condensation unit. On the other hand, when a heating mode is performed, the indoor heat exchanger serves as a condensation unit, and the outdoor heat exchanger serves as an evaporation unit. The switching of the cooling and heating modes may be performed by changing a flow direction of the refrigerant by using the four-way valve.

The refrigeration system may include an air conditioner for selectively controlling cooling and heating operation and a cooler for performing cooling operation to store foods. Thus, it may be required to efficiently operate both air conditioner and cooler through interaction therebetween.

Embodiments provide an integral air conditioning system for heating and cooling in which an outdoor heat exchanger of an air conditioner and an outdoor heat exchanger of a cooler are provided as one unit.

Furthermore, embodiments also provide a valve structure and control unit by which heating performance of an air conditioner and cooling performance of a cooler are maximized.

The present invention provides an integral air conditioning system for heating and cooling, the integral air conditioning system comprising: an air conditioner comprising a first compressor and a first indoor heat exchanger, the air conditioner forming a first refrigeration cycle; a cooler comprising a second compressor and a second indoor heat exchanger, the cooler forming a second refrigeration cycle; an outdoor heat exchanger comprising a first heat exchange part being part of the first refrigeration cycle and a second heat exchange part being part of the second refrigeration cycle; a blower fan for blowing outdoor air into the first heat exchange part and the second heat exchange part, wherein the cooler comprises a sensing part being adapted to detect a pressure and/or temperature of a refrigerant circulating in the second refrigeration cycle; and a branch part comprising a plurality of branches for dividing the refrigerant to be introduced into the second heat exchange part.

Preferably, the system further comprises a control unit configured to compare the detection value received from the sensing part with a preset value, and configured to control the flow of refrigerant through the branches into the second heat exchange part depending on the comparison result.

Further, the system may comprise a plurality of valves disposed in the branches of the branch part.

Furthermore, the control unit may be configured to control an open degree of each of the plurality of valves depending on the comparison result.

Moreover, the control unit may be configured to control the plurality of valves in accordance with a plurality of valve adjustment stages being previously set. Besides, each of the valve adjustment stages may represent an open degree of the plurality of valves.

In addition, the plurality of valve adjustment stages may be ranked according to the amount of the refrigerant condensed in each stage. Besides, the higher the stage number is in the ranking, the lower may be the pressure or temperature of the refrigerant being introduced into the second heat exchange part.

In other words, the valve adjustment stages may include the following plurality of stages. The other stage in which the valves are controlled so that the pressure and/or temperature of the refrigerant circulating into the second refrigeration cycle is less than that of the refrigerant when the valves are controlled to match one stage of the plurality of stages may be a stage higher than the one stage. In addition, the further other stage in which the valves are controlled so that the pressure and/or temperature of the refrigerant circulating into the second refrigeration cycle is greater than that of the refrigerant when the valves are controlled to match the one stage may be a stage lower than the one stage.

The smaller an open degree of the plurality of valves is, the lower ranked may be a valve adjustment stage in the ranking.

Preferably, the second heat exchange part comprises a plurality of branch heat exchange parts, respectively corresponding to the plurality of branches of the branch part. Besides, for the branch heat exchange part being disposed closest to the blower fan, a valve adjustment stage in which the branch heat exchange part is turned on may be ranked higher than one in which the branch heat exchange part is turned off.

Further, the branch part may comprise a plurality of branch tubes. Besides, the plurality of valves may be associated with the plurality of branch tubes, respectively.

Furthermore, the second heat exchange part may comprise a first branch heat exchange part, a second branch heat exchange part disposed further away from the blower fan than the first branch heat exchange part, and a third branch heat exchange part disposed further away from the blower fan than the second branch heat exchange part. Moreover, the plurality of branch tubes may comprise a first branch tube communicating with the first branch heat exchange part, a second branch tube communicating with the second branch heat exchange part, and a third branch tube communicating with the third branch heat exchange part. In addition, the plurality of valves may comprise a first valve associated with the first branch tube, a second valve associated with the second branch tube, and a third valve associated with the third branch tube.

Besides, a valve adjustment stage in which the first valve is turned on, and the second and third valves are turned off may be a stage higher than that in which the first valve is turned off, and the second and third valves are turned off.

Further, when the detection value is greater than the preset value, the control unit may control the plurality of valves to match a valve adjustment stage higher than the stage in which the detection is made.

Furthermore, when the detection value and the preset value are the same, the control unit may control the plurality of valves to maintain the current valve adjustment stage.

Moreover, when the detection value is less than the preset value, the control unit may control the plurality of valves to match a valve adjustment stage lower than the stage in which the detection is made.

In addition, the system may further comprise an intercooler in which the first and the second refrigeration cycles are heat-exchanged with each other.

Besides, the intercooler may be configured to have heat dissipated from the second refrigeration cycle to the first refrigeration cycle.

The sensing part may be disposed at an outlet side of the second compressor.

The first heat exchange part may be disposed closer to the blower fan than the second heat exchange part.

The sensing part may include a temperature sensor and/or a pressure sensor.

Preferably, the blower fan is a single blower fan.

The details of one or more embodiments are set forth in the accompanying drawings and the description below. Other features will be apparent from the description and drawings, and from the claims.

FIG. 5 is a table illustrating an example of valve adjustment stages in accordance with the integral air conditioning system for heating and cooling according to an embodiment.

Description of Configuration of Integral Air Conditioning System for Heating and Cooling Hereinafter, an integral air conditioning system for heating and cooling according to an embodiment will be described in detail with reference to the accompanying drawings.

Figure 1:
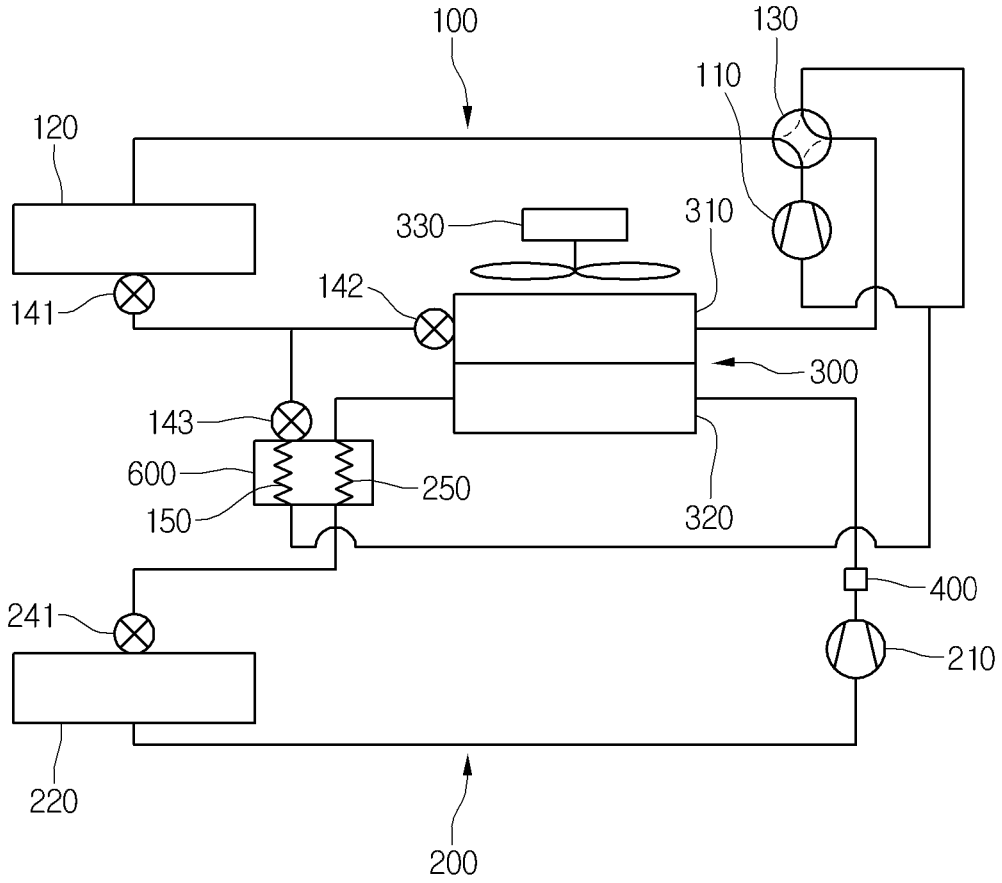
FIG. 1 is a conceptual view of an integral air conditioning system for heating and cooling according to an embodiment.
Figure 4:
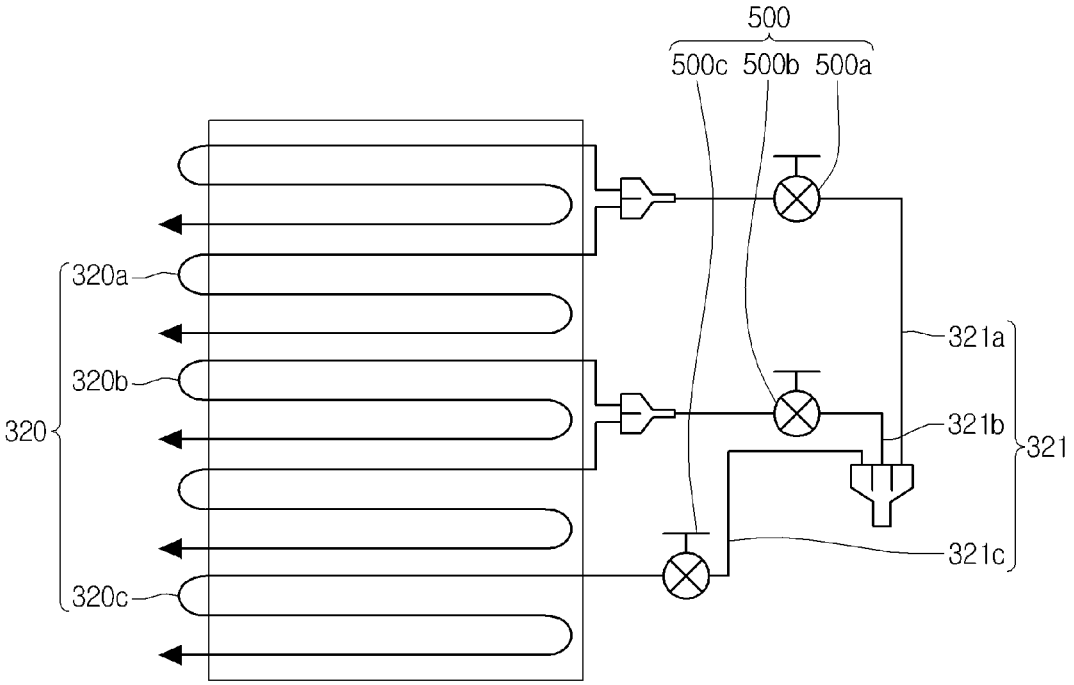
FIG. 4 is a conceptual view illustrating a branch part, a valve, and a second heat exchange part of the integral air conditioning system for heating and cooling according to an embodiment.

Referring to FIGS. 1 and 4, the integral air conditioning system for heating and cooling according to an embodiment may include an air conditioner 100, a cooler 200, an outdoor heat exchanger 300, a sensing part 400, a plurality of valves 500, and an intercooler 600.

The air conditioner 100 performs a first refrigeration cycle including compression-condensation-expansion-evaporation for a first refrigerant.

The air conditioner 100 may include a first compressor 110, a first indoor heat exchanger 120, and air conditioner-side expansion parts 141, 142, and 143.

The first compressor 110 compresses the first refrigerant flowing inside the air conditioner 100.

The first refrigerant and indoor air are heat-exchanged with each other in the first indoor heat exchanger 120.

The air conditioner-side expansion parts 141, 142, and 143 expand the first refrigerant.

A first heat exchange part 310 (that will be described later) of the outdoor heat exchanger 300 serves as an outdoor heat exchanger of the air conditioner 100. That is, the first refrigerant and outdoor air are heat-exchanged with each other in the first heat exchange part 310.

The first compressor 110, the first indoor heat exchanger 120, the air conditioner-side expansion parts 141, 142, and 143, and the first heat exchange part 310 perform the first refrigeration cycle, i.e., the compression-condensation-expansion-evaporation for the first refrigerant.

The air conditioner 100 may further include a four-way valve 130.

The four-way valve 130 switches a flow direction of a refrigerant discharged from the first compressor 110 so that the air conditioner 100 selectively performs a heating operation or a cooling operation.

The air conditioner 100 may further include a first passage 150.

As shown in FIG. 1, the first passage 150 communicates with a refrigerant tube connecting the first indoor heat exchanger 120 to the first heat exchanger part 310 and is disposed inside the intercooler 600 that will be described later. The first refrigerant may pass through the first passage 150 and then be heat-exchanged with a second refrigerant that passes through a second passage 250 (that will be described later) in the intercooler 600.

The cooler 200 performs a second refrigeration cycle including compression-condensation-expansion-evaporation for the second refrigerant.

The cooler 200 may include a second compressor 210, a second indoor heat exchanger 220, and a cooler-side expansion part 241.

The second compressor 210 compresses the second refrigerant flowing inside the cooler 200.

The second refrigerant and indoor air are heat-exchanged with each other in the second indoor heat exchanger 220.

The cooler-side expansion part 241 expands the second refrigerant.

A second heat exchange part 320 (that will be described later) of the outdoor heat exchanger 300 serves as an outdoor heat exchanger of the cooler 200. That is, the second refrigerant and outdoor air are heat-exchanged with each other in the second heat exchange part 320.

The second compressor 210, the second indoor heat exchanger 220, the cooler-side expansion part 241, and the second heat exchange part 320 perform the second refrigeration cycle, i.e., the compression-condensation-expansion-evaporation for the second refrigerant.

Unlike the air conditioner 100, the cooler 200 does not include a four-way valve in FIG. 1. However, the present disclosure is not limited thereto. For example, the cooler 200 may include a four-way valve. When the cooler 200 includes the four-way valve, the cooler 200 may selectively perform a heating operation as well.

The cooler 200 may further include a second passage 250.

As shown in FIG. 1, the second passage 250 may be disposed in-between refrigerant tubes connecting the second heat exchange part 320 and the second indoor heat exchanger 220. The second refrigerant passing through the second passage 250 may be heat-exchanged with the first refrigerant passing through the first passage 150 in the intercooler 600.

Figure 2:
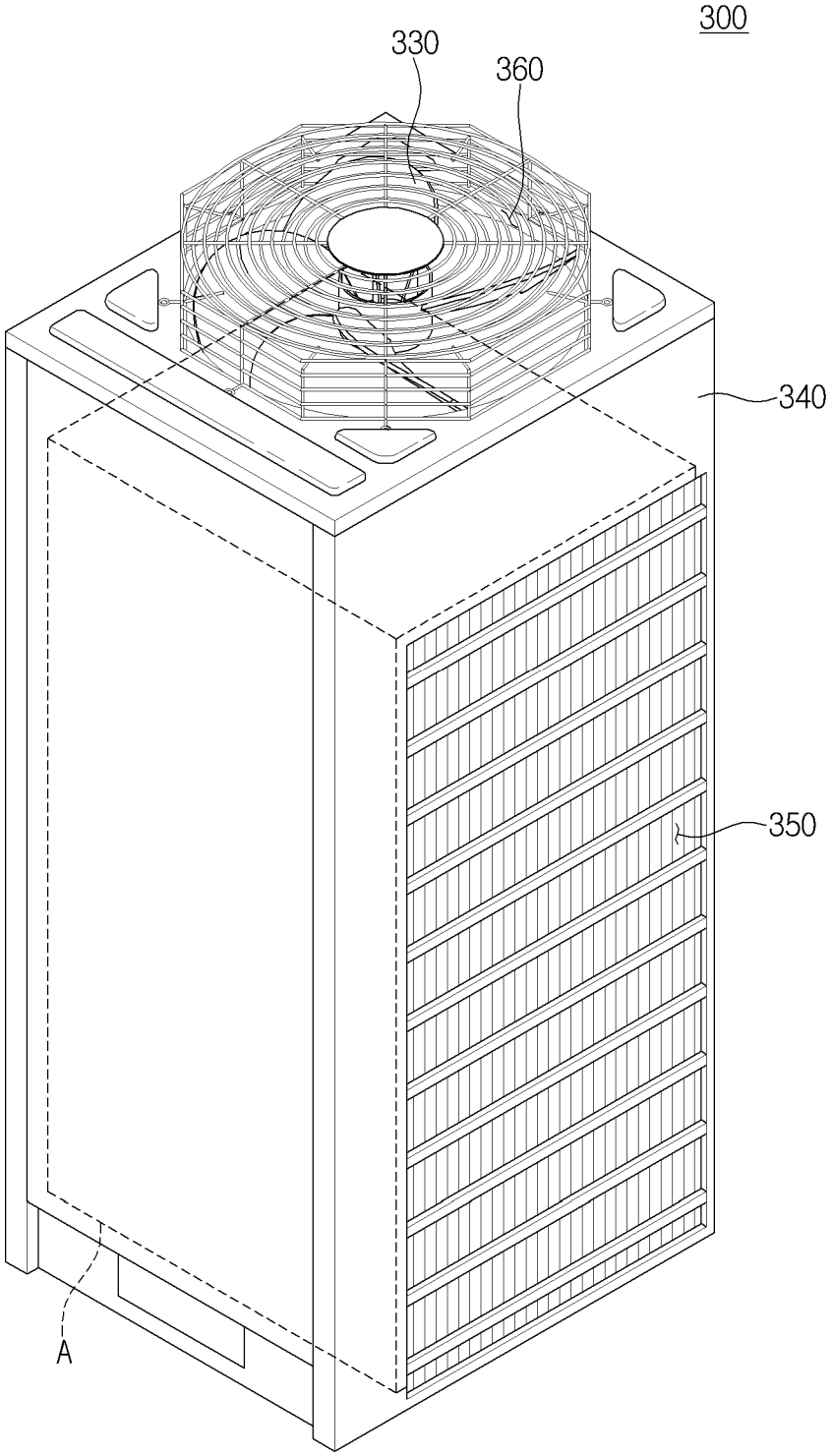
FIG. 2 is a perspective view illustrating an outdoor heat exchanger of the integral air conditioning system for heating and cooling according to an embodiment.
Figure 3:
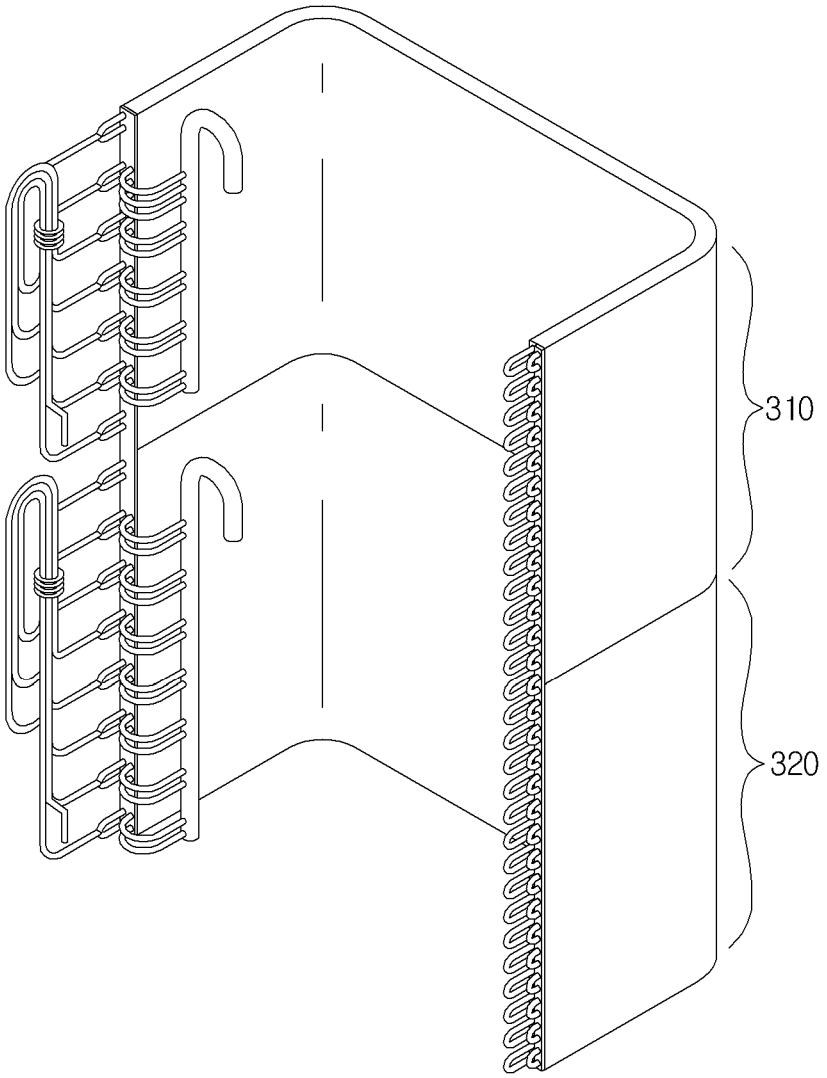
FIG. 3 is a perspective view illustrating first and second heat exchange parts of the integral air conditioning system for heating and cooling according to an embodiment.

Referring to FIGS. 2 and 3, the outdoor heat exchanger 300 may include the first heat exchange part 310, the second heat exchange part 320, a blower fan 330, a chassis 340, a suction hole 350, and a discharge hole 360. Preferably, a single blower fan 300 is provided.

As described above, the first heat exchange part 310 may serve as the outdoor heat exchanger of the air conditioner 100.

Also, the second heat exchange part 320 may serve as the outdoor heat exchanger of the cooler 200.

As shown in FIG. 3, the first and second heat exchange parts 310 and 320 may be vertically arranged, i.e., one on top of the other. However, the present disclosure is not limited thereto. For example, the first and second heat exchange parts 310 and 320 may be arranged horizontally (side-by-side) or forwardly/backwardly with respect to each other.

The first heat exchange part 310 may be disposed closer to the blower fan 330 than the second heat exchange part 320. In this case, a rotation rate of the blower fan 330 may be easily matched with a rotation rate required for the first heat exchange part 310.

As shown in FIG. 3, the first and second heat exchange parts 310 and 320 are vertically disposed with respect to each other within a space A in FIG. 2.

The blower fan 330 blows outdoor air into the first and second heat exchange parts 310 and 320. That is, the blower fan 330 receives power through a driving part (not shown) of a motor, and then is rotated. As a result, the outdoor air may pass through the first and second heat exchange parts 310 and 320 to heat-exchange with the first refrigerant flowing through the first heat exchange part 310 and the second refrigerant flowing through the second heat exchange part 320.

In a conventional air conditioning and cooling system according to a related art, an air conditioner and a cooler include separate outdoor heat exchangers. Thus, separate blower fans may be provided to serve each outdoor heat exchanger. In the current embodiment, the first and second heat exchange parts 310 and 320 are combined and disposed in one chassis 340, and a common blower fan 330 introduces outdoor air into both the first and second heat exchange parts 310 and 320. Thus, when compared to the conventional air conditioning and cooling system according to the related art, the integral air conditioning system for heating and cooling according to the current embodiment may reduce costs for manufacturing and maintaining.

The chassis 340 may be a case for receiving the first heat exchange part 310, the second heat exchange part 320, and the blower fan 330. The suction hole 350 may be a passage through which the outdoor air is introduced, and the discharge hole 360 may be a passage through which the outdoor air flowing out from the heat exchange parts 310 and 320 is discharged.

As shown in FIG. 2, the first heat exchange part 310, the second heat exchange part 320, and the blower fan 330 may be provided as one unit. Also, a plurality of units may be included in the outdoor heat exchanger.

The sensing part 400 is disposed in the cooler 200 to detect a pressure or temperature of the second refrigerant circulating through the second refrigeration cycle. Also, a sensing part may be disposed in the air conditioner 200 to detect a pressure and/or temperature of the first refrigerant circulating through the first refrigerant cycle. The detected values of the pressure or temperature of the first refrigerant may be used for controlling a rotation rate of the blower fan 330.

The sensing part 400 may be disposed at an outlet side of the second compressor 210.

Also, the sensing part 400 may include a temperature sensor and/or a pressure sensor.

Each of the plurality of valves 500 may be adjusted in an open degree thereof to adjust a flow of a refrigerant flowing through a tube including the valve. For example, an open degree may be adjusted into a ½ ON state, a ¼ ON state, and the like.

Also, an opening/closing of each of the plurality of valves 500 may be adjusted through an on/off operation thereof. Thus, the flow of the refrigerant flowing through the tube including the valve 500 may be blocked or not.

For example, as shown in FIG. 4, the plurality of valves 500 may be provided at the branch part 321.

The branch part 321 may include three branch tubes 321*a*, 321*b*, and 321*c*. In this case, three valves 500*a*, 500*b*, and 500*c* may be respectively provided at the three branch tubes 321*a*, 321*b*, and 321*c* to control a flow of the second refrigerant flowing into each of the branch tubes 321*a*, 321*b*, and 321*c*.

The three branch tubes 321*a*, 321*b*, and 321*c* communicate again with three second heat exchange parts 320*a*, 320*b*, and 320*c*. Thus, the three valves 500*a*, 500*b*, and 500*c* respectively provided at the three branch tubes 321*a*, 321*b*, and 321*c* may be turned on/off to change an area and position of the second heat exchange part 320 into which the second refrigerant is introduced.

As described above, the first refrigerant flowing through the first passage 150 and the second refrigerant flowing through the second passage 250 may be heat-exchanged with each other in the intercooler 600. Due to the heat-exchange through the intercooler 600, a coefficient of performance (COP) in the cooler 200 may be relatively increased.

Description of Operation Method of Integral Air Conditioning System for Heating and Cooling First, a cooling operation of the air conditioner 100 will be described.

A first high-temperature high-pressure gaseous refrigerant supplied from the first compressor 110 passes through the four-way valve to flow into the first heat exchange part 310. The first high-temperature high-pressure gaseous refrigerant releases heat into outdoor air through the first heat exchange part 310 and thus is condensed. The condensed first refrigerant is expanded while flowing into a first expansion part 141 of the air conditioner-side expansion parts 141, 142, and 143. The expanded first refrigerant absorbs heat from indoor air while flowing through the first indoor heat exchanger 120 to provide cool air into an indoor room. Here, the first refrigerant is evaporated.

The evaporated first refrigerant may be introduced into the first compressor 110. Then, the first refrigeration cycle may be continuously and repeatedly performed.

In this case, a cooling operation of the cooler 200 may be performed as follows.

A second high-temperature high-pressure gaseous refrigerant supplied from the second compressor 210 flows into the second heat exchange part 320. The second high-temperature high-pressure gaseous refrigerant releases heat into outdoor air through the second heat exchange part 320 and thus is condensed. The condensed second refrigerant may be further condensed by heat-exchanging with the first refrigerant flowing through the first passage 150 while passing through the intercooler 600 via the second passage 250. In more detail, the second refrigerant dissipates heat to the first refrigerant while passing through the intercooler 600, thereby being condensed to a low-temperature high-pressure state. Herein, because the second refrigerant is condensed two times by passing through both the second heat exchange part 320 and the intercooler 600, it can more effectively reach a required low-temperature state compared to going through only one condensation process. As a result, a COP of the cooler 200 is improved.

Moreover, in the present embodiment, the above configuration having the intercooler 600 becomes more advantageous because the first heat exchange part 310 is disposed closer to the common blower fan 33 than the second heat exchange part 320. Because of such an arrangement, the first refrigerant flowing through the first heat exchange part 310 may be more efficiently condensed—when compared to that of the second refrigerant flowing through the second heat exchange part 320. In this case, the heat-exchange between the first and second refrigerants in the intercooler 600, i.e., heat dissipation from the second refrigerant to the first refrigerant, can more occur efficiently; and therefore, a COP in the cooler 200 may be further improved.

The second refrigerant passing through the second passage 250 is expanded in the cooler-side expansion part 241. The expanded second refrigerant absorbs heat from indoor air while flowing through the second indoor heat exchanger 220 and thus is evaporated. Thus, the second indoor heat exchanger 220, for example, may provide cool air into a showcase and the like.

The evaporated second refrigerant may be introduced into the second compressor 210. Then, the second refrigerant cycle may be continuously and repeatedly performed.

Hereinafter, a heating operation of the air conditioner 100 will be described.

A flow direction of the first refrigerant discharged from the first compressor 110 is adjusted by the four-way valve 130 to flow into the first indoor heat exchanger 120. Thus, the first refrigerant releases heat into indoor air and thus is condensed. Also, the first refrigerant flowing through the first indoor heat exchanger 120 is introduced into the second expansion part 142. The second expansion part 142 expands the introduced first high-temperature high-pressure refrigerant. The first refrigerant expanded while flowing through the second expansion part 142 absorbs heat from outdoor air while flowing through the first heat exchange part 310 and thus is evaporated.

The evaporated first refrigerant may be introduced again into the first compressor 110. Then, the first refrigeration cycle may be continuously and repeatedly performed.

In this case, the cooling operation of the cooler 200 is performed basically through the same process as during the above-described cooling operation of the air conditioner 100.

However, the cooling operation of the cooler 200 this time is different from that during the cooling operation of the air conditioner 100 in that the first refrigerant flowing through the first passage 150 is condensed while flowing through the first indoor heat exchanger 120.

Description of Control Method of Integral Air Conditioning System for Heating and Cooling Hereinafter, a control method of the integral air conditioning system for heating and cooling according to an embodiment will be described in detail.

In the control method of the integral air conditioning system for heating and cooling according to an embodiment, the air conditioner 100 performing a heating operation is described as an example. However, based on this description, it is clear to a person skilled in the art to apply the control method to an air conditioner performing a cooling operation.

As described above, the air conditioner 100 performs a heating operation. In this case, the blower fan 330 is controlled so that the blower fan 330 is rotated at a high speed to allow the first refrigerant flowing through the first heat exchange part 310 to be sufficiently heat-exchanged with outdoor air. Thus, a large amount of first refrigerant may be evaporated. Thus, heating performance of the air conditioner 100 may be improved.

However, as described above, when the blower fan 330 is controlled so that the blower fan 330 is rotated at a high speed, the first heat exchange part 310 and the second heat exchange part 320 receiving outdoor air by using a common blower fan 330 may be influenced by the blower fan 330 being rotated in the high speed. In this case, the second refrigerant flowing through the second heat exchange part 320 may excessively release heat into outdoor air. As a result, the high pressure of the second refrigerant circulating through the second refrigeration cycle of the cooler 200 may be generally reduced to deteriorate cooling performance.

To solve the above-described limitations, the integral air conditioning system for heating and cooling according to an embodiment includes the branch part 321 and the plurality of valves 500 to adjust an amount of second refrigerant introduced into the second heat exchange part 320.

Hereinafter, a control method of the plurality of valves 500 will be described. Before that, a "valve adjustment stage" will be described.

For example, a case in which three valves 500 are provided will be described as an example. When the valve 500, as shown in FIG. 4, includes the first valve 500*a*, the second valve 500*b*, and the third valve 500*c* which are respectively disposed at the first branch tube 321*a*, the second branch tube 321*b*, and the third branch tube 321*c*, valve adjustment stages may be set as shown in FIG. 5.

The total stages may be divided into 7 stages, e.g., from stage 1 up to stage 7. Stages relatively close to stage 1 may be called high stages, and stages relatively close to stage 7 maybe called low stages.

In stage 1, all of the first valve 500*a*, the second valve 500*b*, and the third valve 500*c* are turned on; that is, the valves are open. Thus, the second refrigerant is introduced into all the first branch tube 321*a*, the second branch tube 321*b*, and the third branch tube 321*c*. As a result, the second refrigerant is introduced into all the first branch heat exchange part 320*a*, the second branch heat exchange part 320*b*, and the third branch heat exchange part 320*c* and then is heat-exchanged with outdoor air.

In stage 2, the first valve 500*a* and the second valve 500*b* are turned on, and the third valve 500*c* is turned off; that is, two valves are open and one is closed. Thus, the second refrigerant is introduced into the first branch tube 321*a* and the second branch tube 321*b*, but is not introduced into the third branch tube 321*c*. As a result, only the first branch heat exchange part 320*a* and the second branch heat exchange part 320*b* are used for condensing the second refrigerant. When compared with stage 1, since the third branch heat exchange part 320*c* is not used, the total active area of the second heat exchange part 320 is reduced. Thus, an amount of second refrigerant condensed in stage 2 is reduced when compared to that in stage 1.

In stage 3, the first valve 500*a* and the third valve 500*c* are turned on, and the second valve 500*b* is turned off. When compared to stage 2, the state in which the first valve 500*a* is turned on is the same. However, it can be seen that the second valve 500*b* and the third valve 500*c* are changed in the on/off state. In more detail, stage 2 and stage 3 may have the same total active area of the second heat exchange part which is used for condensing the second refrigerant. However, stage 2 is different from stage 3 in that the third branch heat exchange part 320*c* connected to the third valve 500*c* through the third branch tube 321*c* is disposed further away from the blower fan 330 than the second branch heat exchange part 320*b* connected to the second valve 500*b* through the second branch tube 321*b*. Since an amount of outdoor air introduced into the second heat exchange part 320*b* is greater than that of outdoor air introduced into the third branch heat exchange part 320*c* by the blower fan 330, an amount of refrigerant condensed in stage 3 is decreased when compared to that in stage 2.

In stage 4, only the first valve 500*a* is turned on, and the second valve 500*b* and the third valve 500*c* are turned off.

In stage 5, the first valve 500*a* is turned off, and the second valve 500*b* and the third valve 500*c* are turned on. As a result, when compared to stage 5, it may be seen that the total area used for condensing the second refrigerant in stage 5 is larger than in stage 4. Nevertheless, the reason why stage 4 is categorized as a higher ranking stage than stage 5 is because condensation efficiency when only the first branch heat exchange part 320*a* is used is greater than that when the second branch heat exchange part 320*b* and the third branch heat exchange part 320*c* are used because the first branch heat exchange part 320*a* is disposed closer to the blower fan 330 than the second branch heat exchange part 320*b* and the third branch heat exchange part 320*c*.

However, the above-described description does not limit that the first branch heat exchange part 320*a* always has greater condensation efficiency than the sum of those of the second heat exchange part 320*b* and the third branch heat exchange part 320*c*. The branch heat exchange parts 320*a*, 320*b*, and 320*c* may be designed with the same or different size of heat-exchanging area with respect to each other. When the branch heat exchange parts 320*a*, 320*b*, and 320*c* have different size of heat-exchanging areas, the ranking of the stages illustrated in FIG. 5 may be changed. That is, the ranking of the stage illustrated in FIG. 5 may be merely an example for conveniently explaining the present embodiment.

In stage 6, the first valve 500*a* and the third valve 500*c* are turned off, and the second valve 500*b* is turned on.

In stage 7, the first valve 500*a* and the second valve 500*b* are turned off, and the third valve 500*c* is turned on. The above-described relationship between stage 2 and stage 3 may be applied to a relationship between stage 6 and stage 7.

Also, stages 1 to 7 are merely examples for conveniently explaining the present embodiment. For example, the plurality of valves 500 may be controlled to change its degree of openness, not the on/off control. That is, for example, stage 1 is the same as the above-described stage 1. Also, in stage 2, the first valve 500*a* and the second valve 500*b* are turned on, and the third valve 500*c* is turned on about ½ of its full openness.

Figure 6:
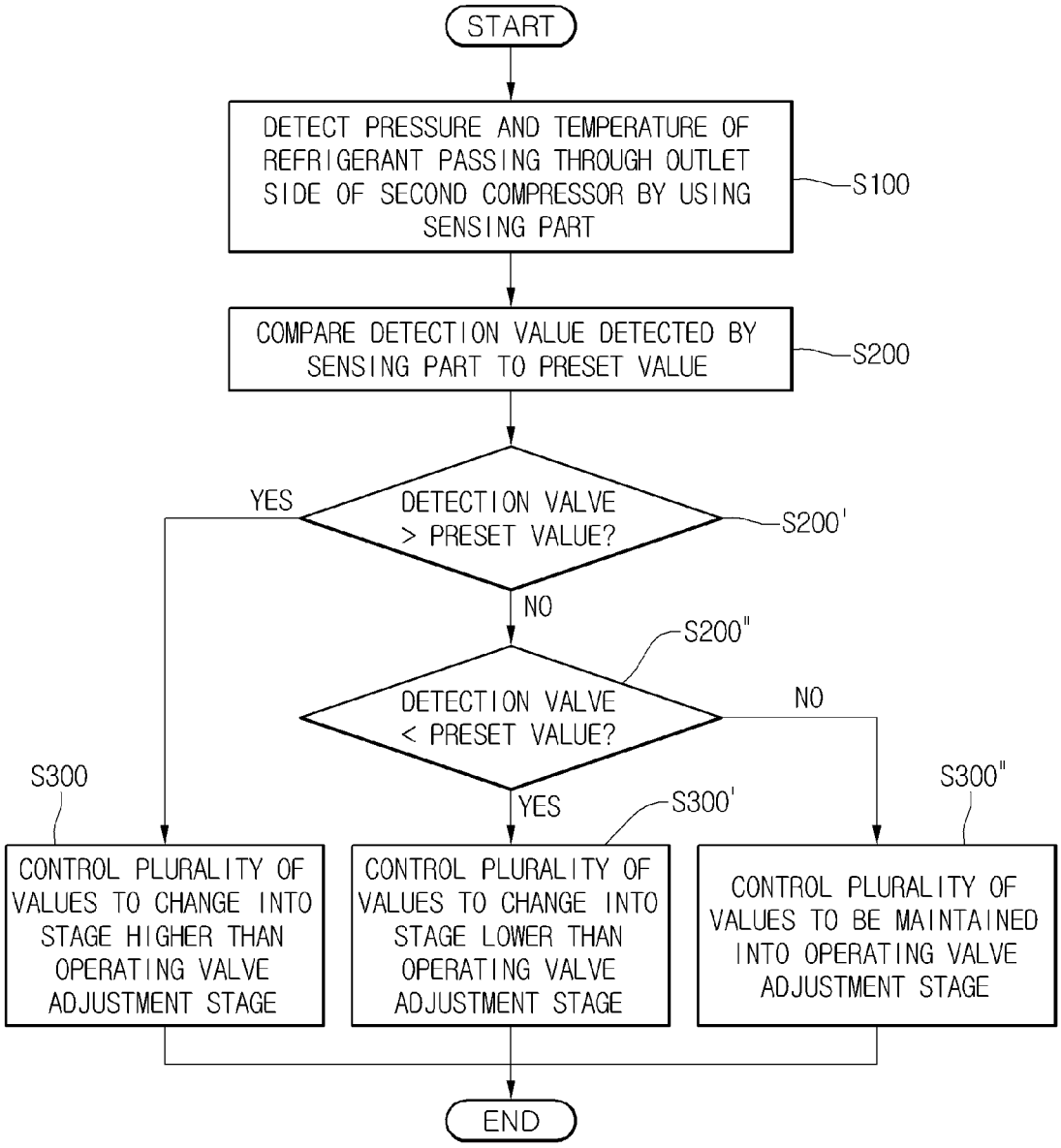
FIG. 6 is a flowchart illustrating sequential order for adjusting the valve in accordance with the integral air conditioning system for heating and cooling according to an embodiment.

On the basis of the above-described valve adjustment stages illustrated in FIG. 5, hereinafter, a control method of the integral air conditioning system for heating and cooling according to an embodiment will be described in detail with reference to FIG. 6.

First, in operation S100, the sensing part 400 detects a pressure or temperature of a refrigerant passing through an outlet side of the second compressor 210. The sensing part 400 may be installed at the outlet side of the second compressor 210. The present disclosure is not limited thereto. For example, the sensing part 400 may be installed anywhere to detect a pressure and/or temperature of the second refrigerant circulating through the cooler 200.

In operation S200, the value detected by the sensing part 400 is compared to a preset value. Here, a separate control part (not shown) for comparing the detected value to the preset value may be provided. The detected value and the preset value may be a pressure or temperature.

In more detail, the comparison between the detected value and the preset value may be, for example, performed as according to the following order. The comparison process may be performed by first asking whether the detected value is greater than the preset value (S200') and then asking whether the detected value is less than the present value (S200"). However, this is merely an example. For example, the comparison process may be reversed in order or simultaneously performed.

If the result in operation S200' is "YES", i.e., if the detected value is greater than the preset value, in operation S300, the plurality of valves 500 are adjusted to match a higher ranking stage, i.e., a stage higher than the valve adjustment stage operated at a time point at which the detected value is detected by the sensing part 400. Thus, a difference between the detected value and the preset value may be reduced. Of cause, as time elapses, the detected value and the preset value may become equal. Since a comparison period and valve control period for the detected value and the preset value may be randomly set by a user, a time at which the detected value and the preset value coincide with each other may be varied.

If the result in operation S200' is "NO", and the result in operation S200" is "YES", i.e., if the detected value is less than the preset value, in operation S300', the plurality of valves 400 are adjusted to match a lower ranking stage, i.e., a stage lower than the valve adjustment stage operated at a time point at which the detected value is detected by the sensing part 400. As a result, a difference between the detected value and the preset value may be reduced. Also, as time elapses, the detected value and the preset value may become equal.

If the result in operation S200' is "NO", and the result in operation S200" is "NO", i.e., if the detected value is equal to the preset value, in operation S300", the plurality of valves 500 is maintained to the valve adjustment stage operated at a time point at which the detected value is detected by the sensing part 400.

As described above, even though the air conditioner 100 performs the heating operation, and the rotation rate of the blower fan 330 is matched with a rotation rate required for the first heat exchange part 310, the required cooling performance of the cooler 200 may be maintained through the control of the valves 500.

As described above, the outdoor heat exchanger of the air conditioner and the outdoor heat exchanger of the cooler which are provided as one unit disposed within one chassis may be provided to reduce manufacturing and maintaining costs.

Even though the air conditioner performs the cooling operation as well as the heating operation, the cooling performance of the cooler may be maximized.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An integral air conditioning system for heating and cooling, the integral air conditioning system comprising:

an air conditioner comprising a first compressor and a first indoor heat exchanger, the air conditioner forming a first refrigeration cycle;

a cooler comprising a second compressor and a second indoor heat exchanger, the cooler forming a second refrigeration cycle;

an outdoor heat exchanger comprising a first heat exchange part being part of the first refrigeration cycle and a second heat exchange part being part of the second refrigeration cycle;

a blower fan for blowing outdoor air into the first heat exchange part and the second heat exchange part;

a sensing part being adapted to detect a pressure and/or temperature of a refrigerant circulating in the second refrigeration cycle;

a branch part comprising a plurality of branches for dividing the refrigerant to be introduced into the second heat exchange part;

a plurality of valves disposed in the branches of the branch part; and a control unit configured to compare the detection value received from the sensing part with a preset value, and configured to control the flow of refrigerant through the branches into the second heat exchange part depending on the comparison result, wherein the control unit is configured to control the plurality of valves in accordance with a plurality of valve adjustment stages being previously set, wherein each of the valve adjustment stages represents an open degree of the plurality of valves, wherein the plurality of valve adjustment stages is ranked according to the amount of the refrigerant condensed in each stage, wherein the higher the stage number is in the ranking, the lower is the pressure or temperature of the refrigerant being introduced into the second heat exchange part, wherein the smaller an open degree of the plurality of valves is, the lower ranked is the valve adjustment stage in the ranking of the plurality of valve adjustment stages, wherein the second heat exchange part comprises:

a first branch heat exchange part, a second branch heat exchange part disposed further away from the blower fan than the first branch heat exchange part, and a third branch heat exchange part disposed further away from the blower fan than the second branch heat exchange part, wherein the branch part comprises:

a first branch tube communicated in with the first branch heat exchange part, a second branch tube communicated in with the second branch heat exchange part, and a third branch tube communicated in with the third branch heat exchange part, wherein the plurality of valves comprise:

a first valve disposed at the first branch tube, a second valve disposed at the second branch tube, and a third valve disposed at the third branch tube, wherein a valve adjustment stage is ranked higher in the ranking of the plurality of valve adjustment stages when the first valve is turned on and the second valve and the third valve are turned off than when the first valve is turned off and the second valve and the third valve are turned on.

2. The integral air conditioning system according to claim 1, wherein when the detection value is greater than the preset value, the control unit controls the plurality of valves to match a valve adjustment stage higher than the stage in which the detection is made, wherein, when the detection value and the preset value are the same, the control unit controls the plurality of valves to maintain the current valve adjustment stage, wherein, when the detection value is less than the preset value, the control unit controls the plurality of valves to match a valve adjustment stage lower than the stage in which the detection is made.

3. The integral air conditioning system according to claim 1, further comprising an intercooler in which the first and the second refrigeration cycles are heat-exchanged with each other.

4. The integral air conditioning system according to claim 3, wherein the intercooler is configured to have heat dissipated from the second refrigeration cycle to the first refrigeration cycle.

5. The integral air conditioning system according to claim 1, wherein the sensing part is disposed at an outlet side of the second compressor.

* * * * *